US008951077B2

(12) United States Patent
Marek

(10) Patent No.: US 8,951,077 B2
(45) Date of Patent: Feb. 10, 2015

(54) WIRE CONNECTING TERMINAL FOR ENAMELED WIRES

(75) Inventor: Jerzy Kowalczewski Marek, Shenzhen (CN)

(73) Assignee: Traftor Technology (Shenzhen) Co., Ltd, Shenzhen, Guangdong (CN)

( * ) Notice: Subject to any disclaimer, the term of this patent is extended or adjusted under 35 U.S.C. 154(b) by 60 days.

(21) Appl. No.: 13/814,622

(22) PCT Filed: May 16, 2011

(86) PCT No.: PCT/CN2011/000853

§ 371 (c)(1),
(2), (4) Date: Feb. 6, 2013

(87) PCT Pub. No.: WO2012/016420

PCT Pub. Date: Feb. 9, 2012

(65) Prior Publication Data

US 2013/0143453 A1 Jun. 6, 2013

(30) Foreign Application Priority Data

Aug. 6, 2010 (CN) ..... 2010 1 0247973

(51) Int. Cl.
*H01R 4/02* (2006.01)
*H01R 11/11* (2006.01)

(52) U.S. Cl.
CPC ..... *H01R 4/029* (2013.01); *H01R 11/11* (2013.01)
USPC ..... 439/875

(58) Field of Classification Search
USPC ..... 439/874–875, 83; 174/84 C, 84 R
See application file for complete search history.

(56) References Cited

U.S. PATENT DOCUMENTS 2,766,436 A 10/1956 Luebking
4,164,971 A 8/1979 Strand (Continued)

FOREIGN PATENT DOCUMENTS

CN 101071909 A 11/2007
CN 101436461 A 5/2009

(Continued)

OTHER PUBLICATIONS

International Search Report (in Chinese with English translation) for PCT/CN2011/000853, mailed Aug. 4, 2011; ISA/CN.

(Continued)

*Primary Examiner* — Jean F Duverne
(74) *Attorney, Agent, or Firm* — Harness, Dickey & Pierce, P.L.C.

(57) ABSTRACT

A wire connecting terminal for enameled wires includes an insulating plate (2) and a pair of conductive bars (1) respectively fixed at two ends of the insulating plate. One end of the said bars is provided with a lead-wire welding hole (1*a*) for welding an external lead wire and the other end of the bars is provided with at least one enameled-wire welding hole (4*a*) for welding an enameled wire (4). The terminal has apparently low impedance, and the tensile strength of the welding points is more than 2000N. Because of being separated from the air, the welding points still remain excellent electrical performance and stability after a long period of operation. When operating in a high frequency vibration environment for a long time, the wire connecting terminal does not loose. The possibility of short circuit which is caused by two ends of a coil contacting directly with each other due to the deformation of the terminal thus can be prevented. The terminal is especially suitable for use in electrical components of high power and frequency.

12 Claims, 2 Drawing Sheets

(56) References Cited

U.S. PATENT DOCUMENTS

| | | | | |
|---|---|---|---|---|
| 4,984,359 | A * | 1/1991 | Clark | 29/879 |
| 5,912,517 | A | 6/1999 | Nishimura et al. | |
| 6,093,036 | A * | 7/2000 | Tohgo et al. | 439/83 |
| 8,105,120 | B2 * | 1/2012 | Sekels et al. | 439/875 |
| 8,248,199 | B2 * | 8/2012 | Tamura et al. | 336/107 |

FOREIGN PATENT DOCUMENTS

| | | | |
|---|---|---|---|
| CN | 101916920 | A | 12/2010 |
| DE | 6937751 | U | 7/1970 |
| DE | 9003672 | U1 | 8/1990 |
| EP | 1139543 | A1 | 10/2001 |
| JP | 2000114905 | A | 4/2000 |
| JP | 2002-217046 | A | 8/2002 |
| JP | 2005-286066 | A | 10/2005 |

OTHER PUBLICATIONS

Extended European Search Report dated Mar. 27, 2014, Reference No. W4018/13-EW, Application No./Patent No. 11814004.5-1801 / 2602871 PCT/CN2011000853.

* cited by examiner

WIRE CONNECTING TERMINAL FOR ENAMELED WIRES

CROSS REFERENCE TO RELATED APPLICATIONS

This application is a Section 371 National Stage Application of International Application PCT/CN2011/000853, filed on May 16, 2011, which claims priority to Chinese Patent Application No. 201010247973.7, filed on Aug. 6, 2010, the entire disclosures of which are incorporated herein by reference.

TECHNICAL FIELD

The present invention relates to a connection terminal for a wire, especially a terminal structure for connecting an enameled wire.

BACKGROUND

There exist windings formed by enameled wires in a magnetic component such as a high-power reactor, an inductor and a voltage transformer. In the prior art, an outgoing wire head of each winding is usually connected to an external wire in a terminal-pressing manner. Under a high-current and high-power environment, when the enameled wires are pressed and welded, usually some quality problems such as pseudo welding or empty welding will arise because the interior of the terminal is sealed. The terminal-pressing manner will lead to the occurrence of gaps, so it is unable to avoid galvanic corrosion, an increase in impedance, and loosening of the terminal during the operation. In addition, due to the high-frequency vibration for a long period of time, a joint is easy to get loose, which thus leads to some adverse effects such as an increase in the impedance, more heat produced during the operation and more power consumption.

Currently, an aluminum wire is usually used by many companies to replace a copper wire so as to reduce the cost. The winding is made of aluminum while the external lead wire is made of copper, which brings about new issues. It is difficult to weld the aluminum wire, and aluminum is easy to be oxidized when welding. In addition, when welding in a traditional terminal-pressing manner, the welding quality is usually poor and the impedance is high. Such a phenomenon is especially obvious if there exist several strands (more than four) of aluminum wires. Copper and aluminum are different metals, and an electrochemical reaction will happen when they are simply connected to each other. After a period of time, the resistance at the junction will increase and the wires are getting hot. As a result, even a fire will be caused. In order to solve these problems, usually several strands of copper conductor cables and aluminum wires are welded together via an aluminum/copper solder wire. However, there still exists the situation where the impedance is high after such a processing. Additionally, there exists a risk of galvanic corrosion when copper and aluminum are in direct contact with each other and exposed to air.

SUMMARY

The present invention aims to overcome the drawback that an outgoing wire of an enameled wire in the prior art is insecure and of a high impedance, thereby to provide a connection terminal for the enameled wire with secure connection and low impedance.

In order to overcome the above-mentioned drawback, the present invention provides a connection terminal for an enameled wire, comprising an insulating plate and a pair of conducting plates secured to both ends of the insulating plate respectively. One end of each conducting plate is provided with a wire connecting hole for connecting an external wire, and the other end is provided with at least one enameled wire welding hole for welding the enameled wire.

Each enameled wire welding hole is merely used for one enameled wire, and the number of the enameled wire welding holes corresponds to the number of the enameled wires to be welded.

In one embodiment, the conducting plates are arranged horizontally. The insulating plate at the portion in contact with the conducting plate is provided with a concave step, the shape of which conforms to that of the conducting plate. At the position corresponding to the concave step, the conducting plate is provided with a screw through-hole, through which a fastening screw passes so as to secure the conducting plate onto the insulating plate. A thread-locking adhesive is coated between the fastening screw and the insulating plate.

In another embodiment, the conducting plates are arranged upright. The insulating plate at the portion in contact with the conducting plate is provided with a concave step, the shape of which conforms to that of the conducting plate. At the position corresponding to the concave step, the conducting plate is provided with a screw through-hole, through which a fastening screw passes so as to secure the conducting plate onto the insulating plate. A thread-locking adhesive is coated between the fastening screw and the insulating plate.

For different applications, the conducting plate may be a copper or aluminum plate, or a copper-aluminum transition plate. When the copper-aluminum transition plate is used, the end of the copper-aluminum transition plate adjacent to a connecting hole of an external cable is made of copper, while the end of the copper-aluminum transition plate adjacent to the enameled wire welding hole is made of aluminum.

As compared to the prior art, the terminal for an enameled wire according to the present invention has an obviously low impedance. In accordance with the physical properties of the solder wire provided by a solder wire provider, the tensile strength of the welding point is usually greater than 2000N. In addition, the welding point is isolated from air, and as a result, it can remain well electrical performances and stability even after a long-time running. It is especially adapted to electric devices with multiple strands of wires operating at high power and high frequency, such as a high-frequency inverter and a multiple-winding reactor. Such a terminal will not get loose and remain integrity of the structure even under high-frequency vibration for a long period of time. The connecting structure of the terminal is firm and reliable, thus it is able to avoid the possibility of short circuit due to direct contact of the two ends of the winding when the terminal is deformed.

BRIEF DESCRIPTION OF THE DRAWINGS

The present invention is described hereinafter in conjunction with the drawings and the embodiments, and in the drawings.

DETAILED DESCRIPTION

Figure 1:
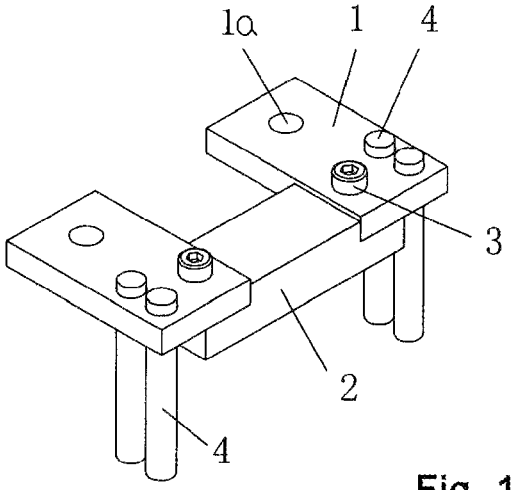
FIG. 1 is a perspective view according to the first embodiment of the present invention.
Figure 2:
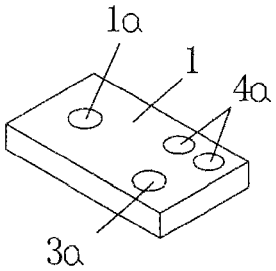
FIG. 2 is a view showing a single conducting plate according to the first embodiment of the present invention.

Referring to FIG. 1, a connection terminal for an enameled wire disclosed by the present invention comprises an insulating plate 2 and a pair of conducting plates 1 secured to both ends of the insulating plate 2 respectively. One end of each conducting plate 1 is provided with a wire connecting hole 1*a* for connecting an external wire, and the other end is provided with at least one enameled wire welding hole 4*a* for welding an enameled wire 4. Each enameled wire welding hole 4*a* is merely used for welding one enameled wire 4, and the number of the enameled wire welding holes 4*a* corresponds to the number of the enameled wires 4 to be welded. FIG. 2 clearly shows the wire connecting hole 1*a* and the enameled wire welding hole 4*a*, which are through holes bored in the conducting plates. The enameled wire 4 is inserted into the enameled wire welding hole 4*a* from the bottom up, and then welded firmly. The insulating plate 2 may be secured to the terminal.

Figure 3:
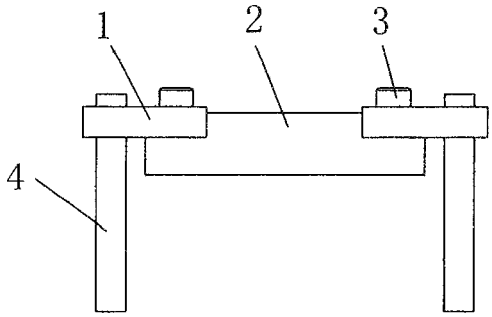
FIG. 3 is a front view according to the first embodiment of the present invention.
Figure 4:
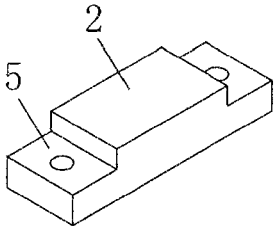
FIG. 4 is a view showing an insulating plate according to the first embodiment of the present invention.
Figure 5:
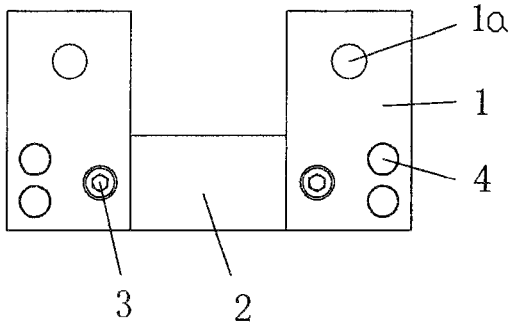
FIG. 5 is a top view according to the first embodiment of the present invention.

According to the first embodiment as shown in FIGS. 1-5, the conducting plates 1 are arranged horizontally and parallel to each other. The insulating plate 2 at the portion where the insulating plate 2 is in contact with the conducting plate 1 is designed as a concave step 5, the shape of which conforms to that of the conducting plate. At the position corresponding to the concave step 5, the conducting plate 1 is provided with a screw through-hole 3*a*, through which a fastening screw 3 passes so as to secure the conducting plate 1 onto the insulating plate 2. FIG. 4 is a perspective view showing the insulating plate according to the first embodiment of the present invention, and such an arrangement aims to define the relative position of the insulating plate 2 and the conducting plate 1. In the terminal of a small or medium scale, the two may be secured to each other firmly by one fastening screw 3, while in the terminal of a large scale, the number of the fastening screws 3 may be increased correspondingly, which depends on the size of the conducting plate. As shown in FIGS. 3 and 5, which are front view and top view according to a preferred embodiment of the present invention, at the position corresponding to the concave step 5, the conducting plate 1 is provided with a screw through-hole 3*a*, through which a fastening screw 3 passes so as to secure the conducting plate 1 onto the insulating plate 2. The conducting plates 1 are bilaterally symmetrical, and the fastening screw 3 is mounted at the position where the conducting plate 1 is in contact with the insulating plate 2. Outside the fastening screw 3 are the enameled wire welding holes 4*a* and the enameled wire 4.

Figure 6:
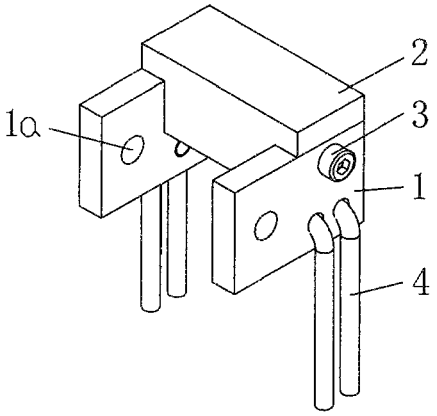
FIG. 6 is a perspective view according to the second embodiment of the present invention.
Figure 7:
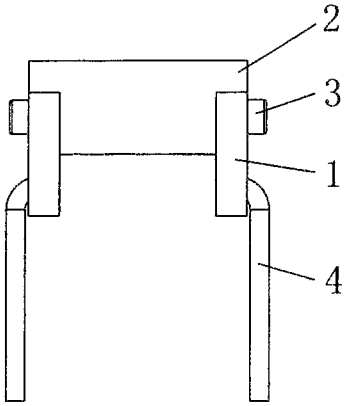
FIG. 7 is a front view according to the second embodiment of the present invention.
Figure 8:
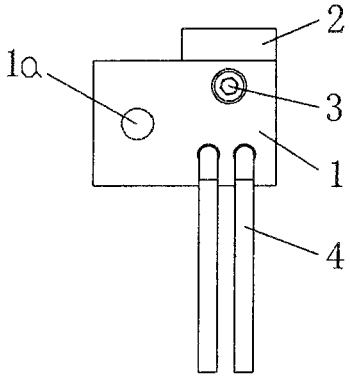
FIG. 8 is a side view according to the second embodiment of the present invention.
Figure 9:
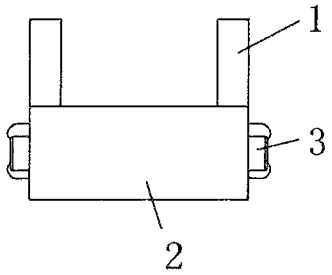
FIG. 9 is a top view according to the second embodiment of the present invention.

According to the second embodiment as shown in FIGS. 6-9, the conducting plates 1 are arranged upright and parallel to each other. The insulating plate 2 at the portion where the insulating plate 2 is in contact with the conducting plate 1 is designed as a concave step 5, the shape of which conforms to that of the conducting plate. At the position corresponding to the concave step 5, the conducting plate 1 is provided with a screw through-hole 3*a*, through which a fastening screw 3 passes so as to secure the conducting plate 1 onto the insulating plate 2. FIG. 6 is a perspective view showing the insulating plate according to the second embodiment of the present invention, and such an arrangement aims to define the relative position of the insulating plate 2 and the conducting plate 1. In the terminal of a small or medium scale, the two may be secured to each other firmly by one fastening screw 3, while in the terminal of a large scale, the number of the fastening screws 3 may be increased correspondingly, which depends on the size of the conducting plate. As shown in FIGS. 7-9, which are front view, side view and top view according to the second embodiment of the present invention, the second embodiment differs from the first embodiment mainly in that the conducting plate 1 is arranged upright rather than horizontally. In the first embodiment, the fastening screws 3 are used to secure the conducting plate 1 onto both ends of the insulating plate 2 in a vertical direction, and the enameled wire 4 passes through the enameled wire welding hole 4*a* from the bottom up and then secured by welding. In the second embodiment, the fastening screws 3*a* are used to secure the conducting plate 1 onto both ends of the insulating plate 2 in a horizontal direction, and the enameled wire 4 passes through the enameled wire welding hole 4*a* from outside to inside and then secured by welding.

In the above-mentioned embodiments, a thread-locking adhesive is coated between the fastening screw 3 and the insulating plate 2. Thread-locking adhesive material with a temperature of 150° C. is used as the thread-locking adhesive. The two terminals and the insulating plate are secured as a whole, cannot be easily displaced or deformed, and cannot get loose even under high frequency vibration for a long period of time. As a result, it is able to avoid the possibility of short circuit due to the direct contact of the insulating plates 2.

The insulating plate 2 is made of a FR4 plate with a relative dielectric constant of about 4.25. Upon calculating, the capacitance between the two conducting plates 1 is $$C = \frac{\varepsilon S}{d} = \frac{3.76295 \times 10^{-11} \times S}{d},$$

when S=50 $mm^2$ and d=15 mm. C=0.12543 pF. When the voltage at both ends of the terminal is 800V, the frequency is 20 kHz, and the charging current of a capacitor between the terminals is merely $10^{-5}$ A. Therefore, it has an excellent insulating property. It has more excellent insulating property especially after the whole inductance has made the vacuum impregnation.

For different applications, when the winding and the external wire are made of copper, the conducting plate 1 may be a copper plate. When the winding is made of aluminum and the external wire is made of copper, considering the factors such as current and heat emission, the conducting plate 1 may be an aluminum plate, or a copper plate which is welded to an aluminum wire via a copper/aluminum solder wire. When the winding is made of aluminum and the external wire is made of copper, the conducting plate 1 may be a copper-aluminum transition plate, where the end of the copper-aluminum transition plate adjacent to an external cable connecting hole 1*a* is made of copper, and the end of the copper-aluminum transition plate adjacent to the enameled wire welding hole 4*a* is made of aluminum. As a result, it is able to avoid welding the aluminum wire directly onto a copper plate, as well as the resultant galvanic corrosion. A grinding-welding process is adopted when welding the copper/aluminum plates, and according to the data from the provider and the actual measurement made by our company, the impedance between the contact surfaces of two conductors reaches a μΩ level.

The above embodiments are merely for illustration, but are not used to limit the present invention. Any modification or variation without departing from the spirit and scope of the present invention shall also fall within the scope of the appended claims.

What is claimed is:

1. A connection terminal for an enameled wire, comprising an insulating plate and a pair of conducting plates secured to both ends of the insulating plate respectively, wherein one end of each conducting plate is provided with a wire connecting hole for connecting an external wire, and the other end is provided with at least one enameled wire welding hole for welding the enameled wire, the conducting plates are arranged horizontally or arranged upright, and the insulating plate at the portion in contact with the conducting plate is provided with concave step, the shape of which conforms to that of the conducting plate, wherein the conducting plate at the position corresponding to the concave step is provided with a screw through-hole, through which a fastening screw passes so as to secure the conducting plate onto the insulating plate, and wherein a thread-locking adhesive is coated between the fastening screw and the insulating plate.

2. The connection terminal for an enameled wire according to claim 1, wherein each enameled wire welding hole is merely used for welding one enameled wire, and the number of the enameled wire welding holes corresponds to the number of the enameled wires to be welded.

3. The connection terminal for an enameled wire according to claim 1, wherein the conducting plate is a copper plate or an aluminum plate.

4. The connection terminal for an enameled wire according to claim 1, wherein the conducting plate is a copper-aluminum transition plate, wherein the end of the copper-aluminum transition plate adjacent to an external cable connection hole is made of copper and the end of the copper-aluminum transition plate adjacent to the enameled wire welding hole is made of aluminum.

5. The connection terminal for an enameled wire according to claim 2, wherein the conducting plate is a copper plate or an aluminum plate.

6. The connection terminal for an enameled wire according to claim 2, wherein the conducting plate is a copper-aluminum transition plate, wherein the end of the copper-aluminum transition plate adjacent to an external cable connection hole is made of copper and the end of the copper-aluminum transition plate adjacent to the enameled wire welding hole is made of aluminum.

7. A connection terminal for an enameled wire, comprising an insulating plate and a pair of conducting plates secured to both ends of the insulating plate respectively, wherein one end of each conducting plate is provided with a wire connecting hole for connecting an external wire, and the other end is provided with at least one enameled wire welding hole for welding the enameled wire, and wherein the conducting plates are arranged horizontally or arranged upright, and the insulating plate at the portion in contact with the conducting plate is provided with a concave step, the shape of which conforms to that of the conducting plate.

8. The connection terminal for an enameled wire according to claim 7, wherein each enameled wire welding hole is merely used for welding one enameled wire, and the number of the enameled wire welding holes corresponds to the number of the enameled wires to be welded.

9. The connection terminal for an enameled wire according to claim 8, wherein the conducting plate is a copper plate or an aluminum plate.

10. The connection terminal for an enameled wire according to claim 8, wherein the conducting plate is a copper-aluminum transition plate, wherein the end of the copper-aluminum transition plate adjacent to an external cable connection hole is made of copper and the end of the copper-aluminum transition plate adjacent to the enameled wire welding hole is made of aluminum.

11. The connection terminal for an enameled wire according to claim 7, wherein the conducting plate is a copper plate or an aluminum plate.

12. The connection terminal for an enameled wire according to claim 7, wherein the conducting plate is a copper-aluminum transition plate, wherein the end of the copper-aluminum transition plate adjacent to an external cable connection hole is made of copper and the end of the copper-aluminum transition plate adjacent to the enameled wire welding hole is made of aluminum.

* * * * *